US006343574B1

(12) United States Patent
Leonard et al.

(10) Patent No.: US 6,343,574 B1
(45) Date of Patent: Feb. 5, 2002

(54) LOAD DISTRIBUTION RIB FOR THE COMBUSTION DECK OF AN INTERNAL COMBUSTION ENGINE

(75) Inventors: Jay F. Leonard, Simpsonville, SC (US); John S. Foy, Columbus, IN (US); Terrence M. Shaw, Columbus, IN (US); David R. Glackin, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/474,323

(22) Filed: Dec. 29, 1999

(51) Int. Cl.[7] ..... F02F 1/36
(52) U.S. Cl. ..... 123/41.82 R
(58) Field of Search ..... 123/193.5, 41.82 R, 123/41.74, 193.3

(56) References Cited

U.S. PATENT DOCUMENTS

| | | | | | |
|---|---|---|---|---|---|
| 1,716,256 | A | | 6/1929 | Birkigt | |
| 2,788,776 | A | * | 4/1957 | Holt | 123/41.48 R |
| 5,503,128 | A | | 4/1996 | Hickey et al. | 123/470 |
| 5,586,522 | A | | 12/1996 | Phillis et al. | 123/41.82 R |
| 5,651,337 | A | | 7/1997 | Regueiro | 123/90.27 |
| 5,697,345 | A | | 12/1997 | Genter et al. | 123/470 |
| 5,706,786 | A | | 1/1998 | Stephanus et al. | 123/470 |
| 5,809,946 | A | | 9/1998 | Abe | 123/41.74 |
| 5,873,331 | A | * | 2/1999 | Jutz | 123/193.5 |
| 5,964,196 | A | * | 10/1999 | Sigle et al. | 123/193.5 |
| 6,024,057 | A | * | 2/2000 | Betchaku | 123/193.5 |

* cited by examiner

*Primary Examiner*—Tony M. Argenbright
*Assistant Examiner*—Hyder Ali
(74) *Attorney, Agent, or Firm*—Woodard, Emhardt, Naughton, Moriarty & McNett

(57) ABSTRACT

A unitary combustion deck for an internal combustion engine includes a main body portion having a cylinder-facing surface and a coolant-side facing surface. The combustion deck further includes a plurality of bolt bosses which are integrally cast as part of the coolant-side surface and each bolt boss defines a bolt-receiving aperture which extends through the main body portion and which is designed to receive a mounting bolt for securing the combustion deck to a cylinder block for sealing against the leakage of combustion gases. Further included as part of the combustion deck is a load distribution rib which is constructed and arranged to extend in a ring-like form around the at least one cylinder while integrally connecting with each bolt boss of the plurality of bolt bosses.

20 Claims, 8 Drawing Sheets

LOAD DISTRIBUTION RIB FOR THE COMBUSTION DECK OF AN INTERNAL COMBUSTION ENGINE

BACKGROUND OF THE INVENTION

The present invention relates in general to load distribution arrangements which are designed to distribute the force at one location over a larger area. Included within the broad class of load distribution arrangements are those designs which transfer a loading or clamping force from one location to another. This other location may represent a more central portion of an object, such as a fuel injector body. U.S. Pat. No. 5,503,128, issued Apr. 2, 1996 to Hickey et al. is one example of this type of arrangement. Other examples of load distribution arrangements can be found in U.S. Pat. No. 5,697,345, issued Dec. 16, 1997 to Genter, and in U.S. Pat. No. 5,706,786, issued Jan. 13, 1998 to Stephanus et al.

In each of these three patents the corresponding load distribution arrangement includes the addition of a separate component which is assembled into the existing structure. While still being quite beneficial to the overall assembly, the fabrication and assembly of this separate component represents an added cost with added labor required in order to perform the necessary disassembly and assembly steps to incorporate this additional component.

Not all load distribution arrangements require the assembly or integration of a separate component. It is possible, and in the right circumstances may be preferred, to incorporate the structure(s) required for load distribution or force transferring directly into an existing component. U.S. Pat. No. 5,873,331, issued Feb. 23, 1999 to Jutz, discloses one such arrangement for transmitting a force from one location to another where the specific feature is incorporated into an existing component. In the case of U.S. Pat. No. 5,873,331, this existing component is a cylinder head casting for a multi-cylinder internal combustion engine. The incorporated feature is a series of walls that connect the bolt mounting columns. The "four corners" arrangement of the bolt mounting columns results in a total of four walls boxing in each cylindrical combustion chamber.

If we focus this discussion on multi-cylinder internal combustion engines, it will be appreciated that the generally cylindrical combustion chamber needs to be sealed so that the efficiency of the combustion process is not compromised. While a "perfect" seal may not be possible in view of the numerous interfaces which are subject to leakage and the operating stresses which are generated during the combustion process, there is a continuing desire to perfect the seal as much as possible.

Cylinder heads, specifically the combustion decks, have traditionally had problems sealing combustion gas within the cylinder, especially in between the head anchoring bolts whenever there is a long span between bolts. Problems sealing combustion gas also occur in those designs where there is low bending stiffness in the mating components. The primary reason for these problems in sealing is that it is difficult to distribute the bolt load uniformly around the combustion seal. The current problem, and the concerns over combustion gas sealing, will likely become even greater as diesel engines go to higher cylinder pressures for performance and emissions considerations. Part of the challenge is due to the current configuration which includes locating the attachment bolts for the combustion deck at what could be described as fixed points or discrete locations. Typically four or more (eight maximum) bolts are used for each cylinder. This means that a circular interface is being sealed (or at least is trying to be sealed) by the use of four to eight bolts placed at discrete locations around each cylinder. The four-walls design of the Jutz patent only accents the mismatch of geometric shapes. The box-like arrangement is not shaped so as to extend uniformly around the entire circular interface for each cylinder. The result is that portions of the box-like frame of Jutz are closer to the circular edge and other portions are farther apart, contributing to a condition of non-uniformity. The raised walls of Jutz also represent an inefficiency in that there are more significant material costs and added weight with this design. Additional bolts may be positioned around the perimeter of the cylinder, but even with this addition, significant fluctuations in sealing load will occur.

As for other possibilities for addressing the need for improved sealing around the cylinder in order to hold in all of the combustion gas, simply making the combustion deck of the head thicker can help the sealing problem, but this approach introduces high thermal stresses which generally compromise head durability. The typical option which is employed is to increase the bolt loading, but that increases the bolt and bolt bore sizes, resulting in a higher cost and a heavier product. Further, this option is not always effective in correcting or fixing any combustion gas leakage. Another option which might be considered is to reduce the span between the bolts. However, the longest bolt span is typically governed by the bore size and the spacing between cylinders. Accordingly, very little can be done to actually reduce the longest span between bolts.

In order to address what are believed to be shortcomings and limitations with earlier designs and in order to improve upon the sealing efficiency, the present invention was conceived. The present invention provides a circular back up rib on the coolant side of the combustion deck. This circular back up rib is positioned very near to the combustion seal and extends to intersect the head bolt bosses. This rib helps to distribute the bolt loading (typically applied at four to eight discrete locations around the perimeter of each cylinder) more evenly over and more uniformly around the combustion seal. The rib also provides a more uniform stiffness over the circumferential area of the seal. Additionally, the rib offers more surface area (for the head) directly in contact with coolant, allowing the head to run cooler. By reducing the head operating temperature, the corresponding or resulting thermal stresses are reduced. The rib also reduces the deflections due to cylinder pressure loads, thus reducing the stresses and strains which are seen by the cylinder head.

The arrangement contemplated by the present invention accomplishes its various improvements in a manner and by a structure which are novel and unobvious.

SUMMARY OF THE INVENTION

A unitary combustion deck for an internal combustion engine having at least one cylinder according to one embodiment of the present invention includes a main body portion having a cylinder-facing surface and a coolant-side surface, a plurality of bolt bosses integral with the coolant-side surface, each bolt boss of this plurality defining a bolt-receiving aperture which extends through the main body portion and a load distribution rib constructed and arranged to extend in a ring-like form around the cylinder while integrally interconnecting with each bolt boss of the plurality of bolt bosses.

One object of the present invention is to provide an improved combustion deck for an internal combustion engine.

Related objects and advantages of the present invention will be apparent from the following description.

DESCRIPTION OF THE PREFERRED EMBODIMENT

Figure 1:
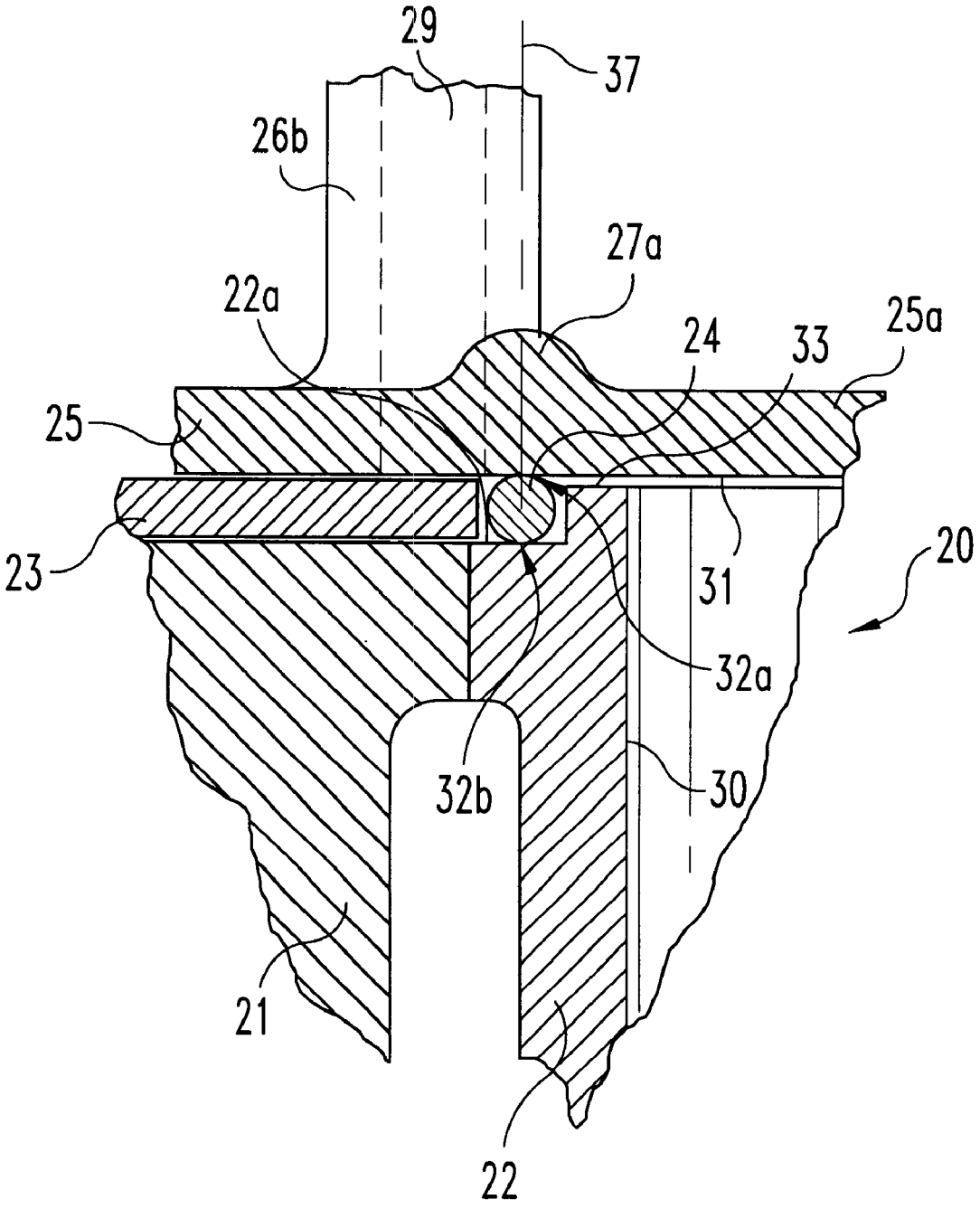
FIG. 1 is partial, side elevational view in full section of a combustion chamber including the interfaces to be sealed and a load distribution rib as part of the combustion deck as viewed along plane 1—1 in FIG. 3 according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
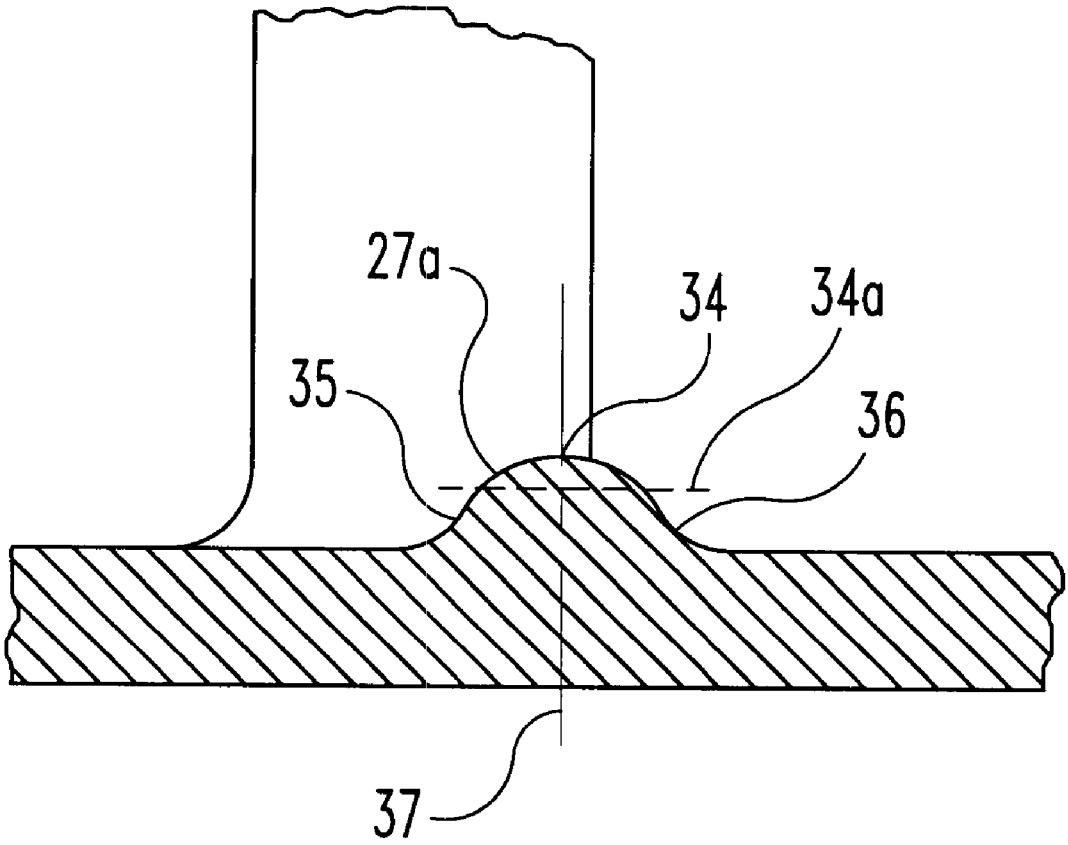
FIG. 2 is a side elevational view in full section of the FIG. 1 load distribution rib.
Figure 3:
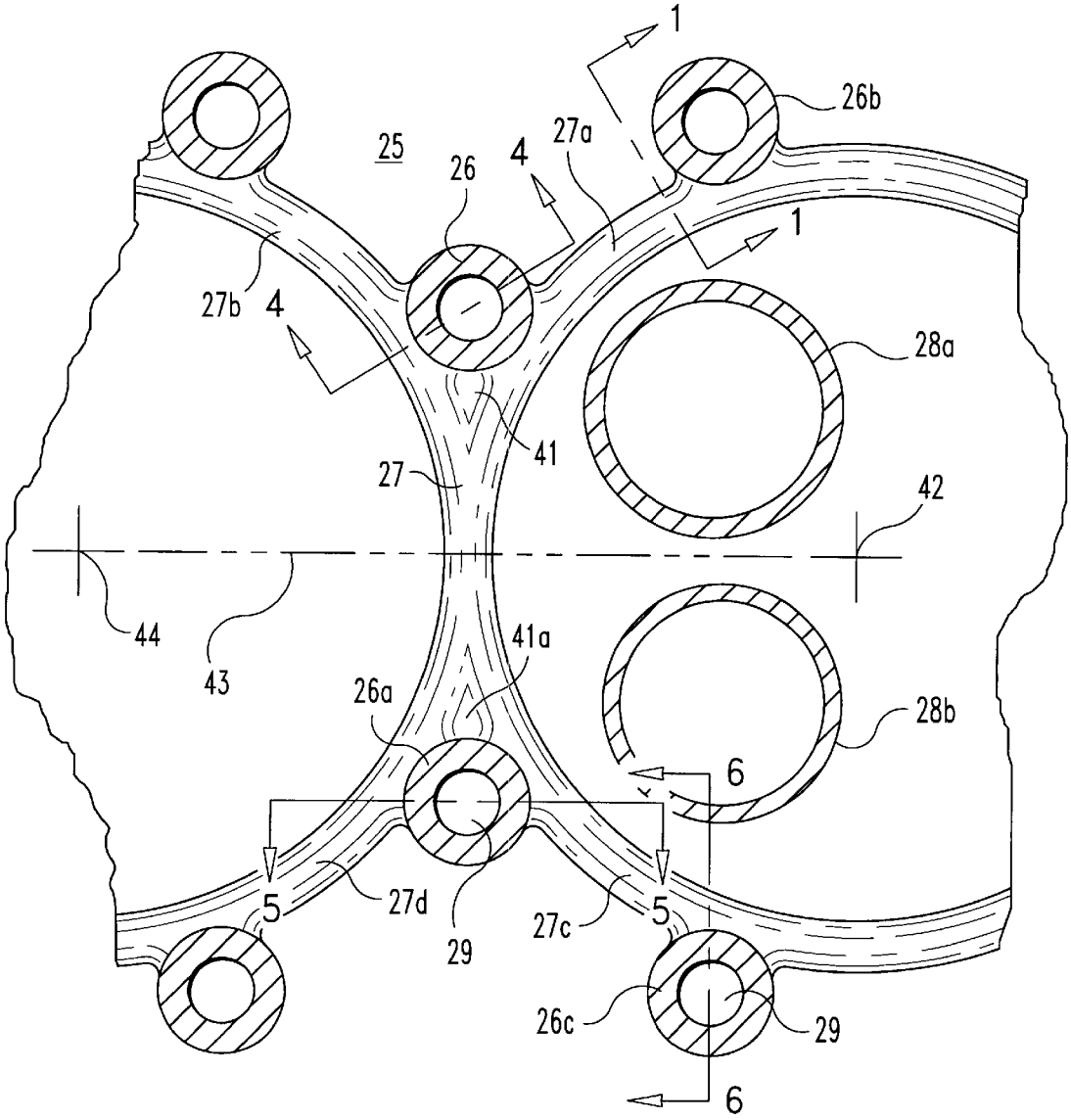
FIG. 3 is a partial, diagrammatic top plan view of a combustion deck including a load distribution rib according to the designs of FIGS. 1 and 2.

Referring to FIGS. 1, 2, and 3, a portion of an internal combustion engine cylinder 20 is illustrated. FIG. 1 is based upon cutting plane 1—1 in FIG. 3 and FIG. 2 is a detail view of FIG. 1. Included as part of the FIG. 1 illustration is a cylinder block 21, cylinder liner 22, gasket 23, combustion seal 24, combustion deck 25, and one bolt boss 26*b* of a plurality of similar bolt bosses (see FIG. 3). Cast as part of the combustion deck 25, as a unitary component, is a load distribution rib 27*a* according to the present invention. Also illustrated are two valve port walls 28*a* and 28*b* which have been illustrated as having a generally circular cross sectional shape which more accurately describes the corresponding openings through the combustion deck for these two valve ports. The two valve port walls 28*a* and 28*b* which define the corresponding ports (i.e., flow passageway) are actually arcuate in their form as they extend upwardly away from combustion deck 25. The arcuate bodies actually define a passageway shape, in lateral cross section, which is more oval than circular. For drawing simplicity and clarity, the two valve port walls 28*a* and 28*b* have been given a circular shape.

As would be understood with regard to typical cylinder designs and the arrangement of multiple cylinders as part of an internal combustion engine, the combustion process generates substantial interior pressure which is applied against the inside surface 30 of the cylinder liner 22 and against the inner surface 31 of the combustion deck 25. The interfaces 32*a* and 32*b* disposed between combustion seal 24 and surface 31 are the primary locations at which combustion gas might escape, except of course for the exhaust valve(s) and exhaust port(s), if the intended sealing is not complete. In order to try and back up these interfaces 32*a* and 32*b* and facilitate the completeness and integrity of the sealing of interfaces 32*a* and 32*b* against combustion gas leakage, seal 24 and gasket 23 are provided. Ultimately though, the effectiveness of the intended sealing of interfaces 32*a* and 32*b* depends to a great degree on the clamping force applied by the head bolts which extend through the plurality of bolt bosses 26 and plastically deforms the combustion seal 24. As is illustrated and as would be understood, each bolt boss defines a bolt-receiving aperture 29 which extends through the combustion deck.

Figure 4:
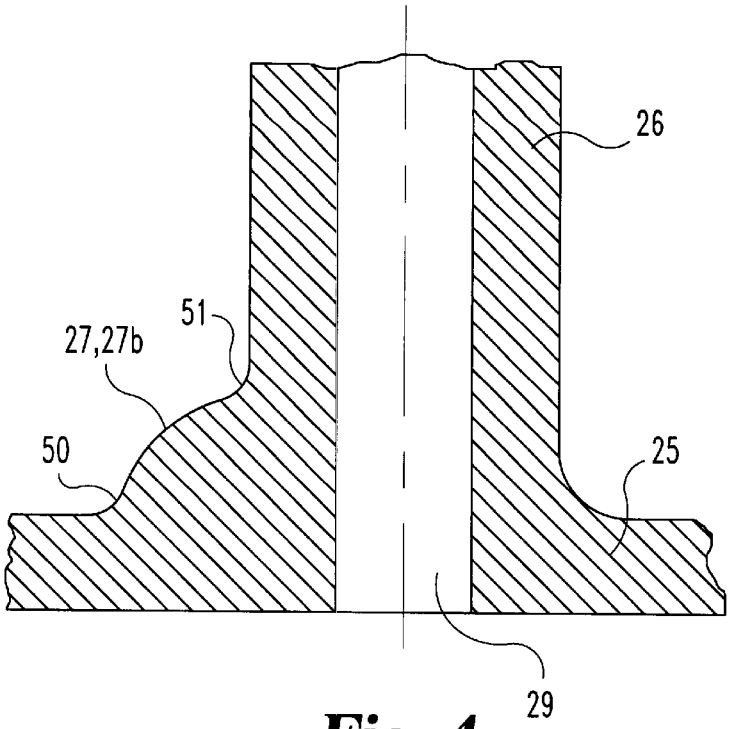
FIG. 4 is a side elevational view in full section of an interface plane between a load distribution rib and a bolt boss as viewed along plane 4—4 in FIG. 3 according to the present invention.
Figure 5:
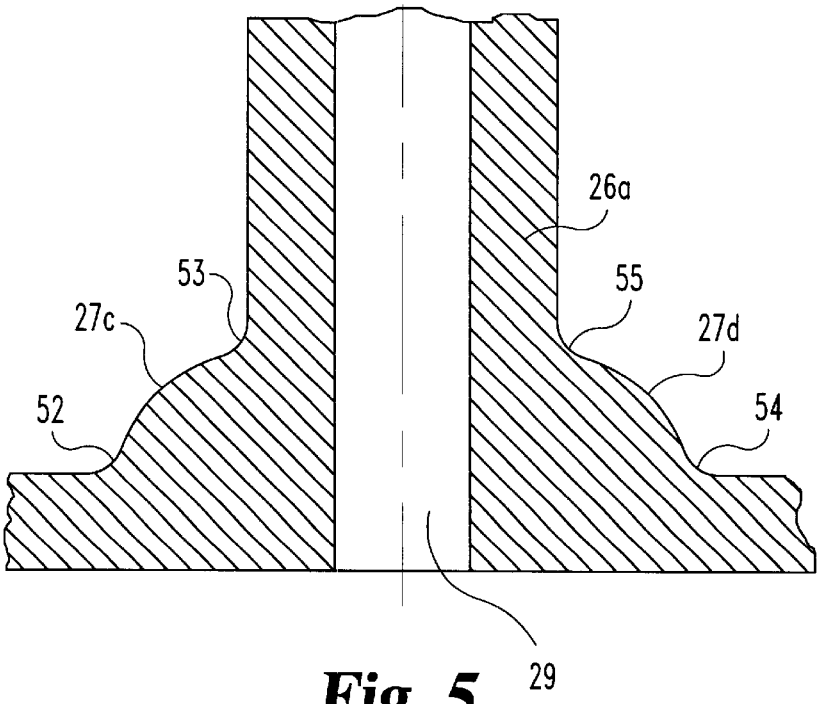
FIG. 5 is a side elevational view in full section of another interface plane between a load distribution rib and a bolt boss as viewed along plane 5—5 in FIG. 3 according to the present invention.
Figure 6:
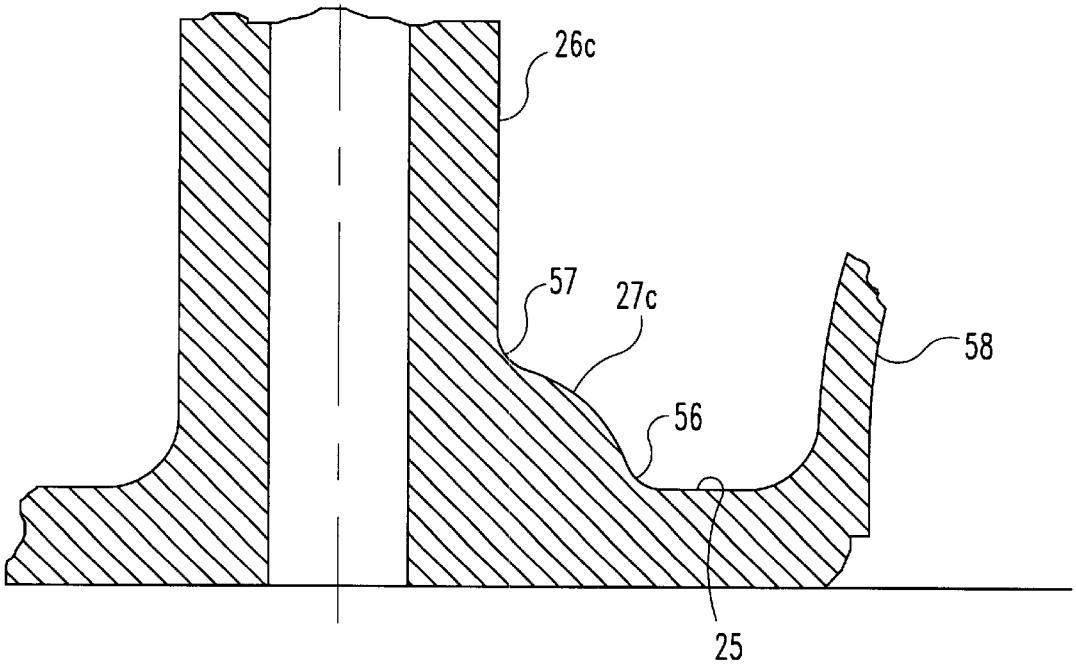
FIG. 6 is a side elevational view in full section of another interface plane which includes part of a valve port wall as viewed along plane 6—6 in FIG. 3 according to the present invention.

Due to the cylindrical shape of cylinder liner 22, the top edge has an annular flat portion 22*a* against which the combustion seal needs to be clamped in order to effectively and reliably seal interfaces 32*a* and 32*b*. In order to improve the sealing effectiveness at interfaces 32*a* and 32*b*, the combustion deck 25 is cast as a unitary component, including a main body portion 25*a*, a plurality of bolt bosses 26, 26*a*, 26*b*, 26*c*, etc., and load distribution rib 27. The load distribution rib 27 has a series of circular, part-circular, or annular ring portions 27*a*, 27*b*, 27*c*, 27*d*, etc. (see FIG. 3), associated with each cylinder, as illustrated, so as to encircle each interface. The cross sectional shape of rib 27*a* in FIGS. 1 and 2 shows a relatively flat, bell-shaped form which is at least 3.18 mm (⅛ inch) high, but could be higher depending on how much space is available. A greater height for rib 27*a* at its peak 34 is preferred and depends (i.e., is limited by) the manufacturing processes and the specific head design. A height of up to 2.54 cm (1.0 inch) would be realistic. In the illustrated embodiment of FIGS. 1–3, there is a smooth and gradual curvature on both sides 35 and 36 of peak 34 which is smoothly rounded. Alternatively, peak 34 can have a flat upper surface rather than being rounded, thereby providing more rib mass for the same overall height. This flat upper surface is suggested by broken line 34*a*. As for the radial or lateral positioning of the peak (and rib) centerline 37, this line generally coincides with the centerline location of seal 24, but may be shifted (i.e., offset) by up to as much as one multiple of the thickness of combustion deck 25. The rib 27 also includes a flared portion 41 which is configured to join each bolt boss 26 and to join up with the adjacent annular ring form 27*b* of rib 27. A similar and symmetrical arrangement of rib portions is present on the opposite side of line 43 as illustrated by rib 27, rib portions 27*c* and 27*d*, and flared portion 41*a*. Construction line 43 connects between the axial centerline 42 of one cylinder and the axial centerline 44 of the adjacent cylinder. Throughout this top plan configuration of rib 27 with annular ring forms 27*a*, 27*b*, 27*c*, and 27*d* as illustrated in FIG. 3, the cross sectional shape of rib 27 and its associated rib portions substantially corresponds to that illustrated in FIGS. 1 and 2, which is actually for rib portion 27*a*, though the dimensions will vary depending on the location of the geometric cutting plane. Examples of other corresponding interfaces for rib 27 and bolt boss 26, depending on the cutting plane, are best illustrated in FIGS. 4, 5 and 6. The locations of the geometric cutting planes for these three figures are illustrated in the top plan view of FIG. 3.

With continued reference to FIG. 3, the load distribution rib 27 which is associated with cylinder centerline 42 extends into a circular, annular ring form 27*a* which is concentric with the cylinder axial centerline 42. As rib 27 approaches bolt boss 26, it diverges such that annular ring form 27*a* circles to the right and annular ring form 27*b* circles to the left. As this split occurs, the mass of added metal placed on the upper surface of the combustion deck widens and creates what has been identified as flared portion 41. This load distribution rib geometry is repeated in a symmetrical manner relative to bolt boss 26*a*.

As rib 27 extends from bolt boss 26 in the direction of bolt boss 26*b* , the top plan geometry of rib 27 changes slightly due to the relatively close spacing between bolt boss 26 and bolt boss 26*b* as compared to the distance between bolt boss 26 and bolt boss 26*a* which represents the longest or greatest bolt span. The top plan geometry of the load distribution rib 27 includes width and edge shape variations which are influenced by how the path of the rib intersects and how it interfaces with each bolt boss. The load distribution rib cross section features remain substantially the same as that illustrated in FIGS. 1 and 2, though with varying dimensions as needed to accomplish an optimally uniform load distribution. In effect longer bolt spans should have more substantial ribs if possible.

Load distribution rib 27 (as well as annular ring forms 27*a*, 27*b*, 27*c*, 27*d*, etc. for each corresponding cylinder) provides a back up rib on the coolant side of the combustion deck 25 (as a unitary combination) above the combustion seal 24. The interconnected annular ring forms 27*a*, 27*b*, etc., one for each cylinder, link up and tie together each of the bolt bosses. This arrangement of the annular ring forms and the flared portions comprise the load distribution rib 27. This rib in cooperation with the bolt bosses helps to distribute the bolt loads more evenly over the combustion seal 24. This arrangement also provides a more uniform stiffness over the area of the combustion seal. Further, the load distribution rib 27 provides more overall surface area for the head (combustion deck) which is in direct contact with the coolant, allowing the head to run cooler and lower the resulting thermal stresses. The arrangement of rib 27 and its interconnect with the bolt bosses reduces the deflections due to cylinder pressure loads, thus reducing the alternating deflections and thus the alternating stresses and strains which are transmitted into the cylinder head. The effect is a product with a better fatigue life. The more uniform loading allows the engine designer to use a lower ratio total bolt load to cylinder pressure unloading force which allows for higher cylinder pressures for a given bolt size. This design flexibility becomes important as emission specifications push designers toward higher cylinder pressures. Another design option which is permitted by the present invention is to remove material from other regions of the head that run very hot, such as valve bridge regions.

Continuing with the description of the present invention and with reference to FIGS. 4, 5, and 6, different cutting planes are utilized so as to illustrate the cross sectional geometry of the corresponding rib or rib portion (27, 27*a*, 27*b*, 27*c*, 27*d*) and its blended unitary construction relative to one of the bolt bosses (26, 26*a*, 26*b*, 26*c*).

In the FIG. 4 illustration, rib 27 is transitioning into rib portion 27*b* as the rib encircles the adjacent cylinder and its axial centerline 44. The interface between the rib and bolt boss 26 is illustrated, noting that the rib smoothly transitions and blends between combustion deck 25 and bolt boss 26 by large radiused fillets 50 and 51, each of which has a concave curvature.

In the FIG. 5 illustration, rib 27 has transitioned through flared portion 41*a* and split into rib portions 27*c* and 27*d*. There is a centered and symmetrical relationship between rib portions 27*c*, 27*d*, and bolt boss 26*a* such that the left side and right side interfaces between the rib portions and the bolt boss are virtually identical based on a cutting plane which is parallel to the plane between cylinder axis lines 42 and 44. As illustrated in FIG. 5, the interfaces between the ribs 27*c* and 27*d* relative to the exterior surface of bolt boss 26*a* are smoothly transitioned by means of large radiused fillets 52–55, each of which has a concave curvature.

In the FIG. 6 illustration, a portion of a valve port wall 58 is included. The interface between rib portion 27*c* and bolt boss 26*c* is similar to the interfaces in FIGS. 4 and 5, including large radiused fillets 56 and 57, each of which has a concave curvature.

Figure 7A:
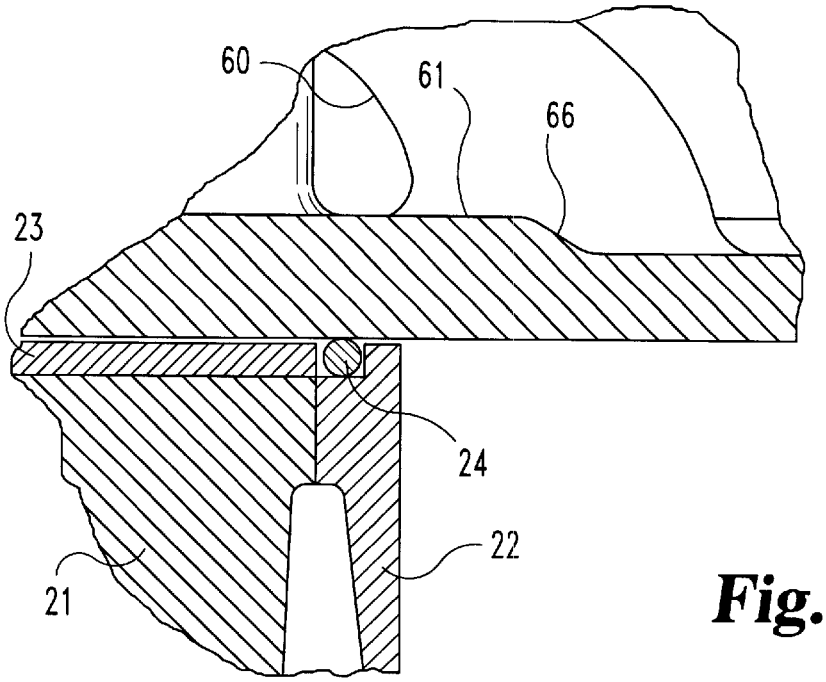
FIG. 7A is a side elevational view in full section of an alternative load distribution rib as viewed along plane 7A—7A in FIG. 8A according to the present invention.
Figure 7B:
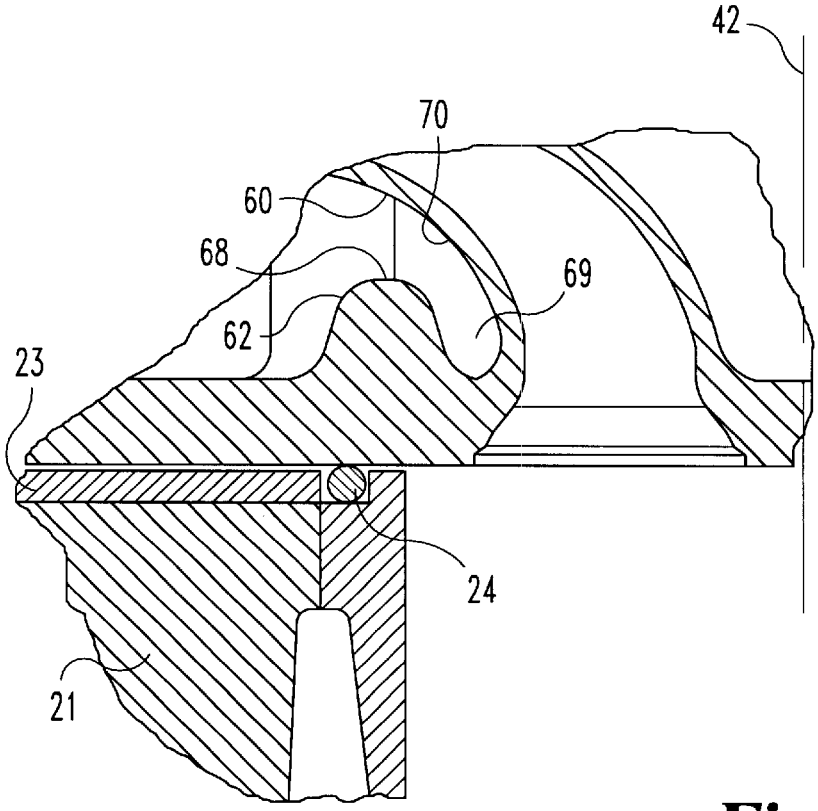
FIG. 7B is a side elevational view in full section of another alternative load distribution rib as viewed along plane 7B—7B in FIG. 8B according to the present invention.
Figure 8A:
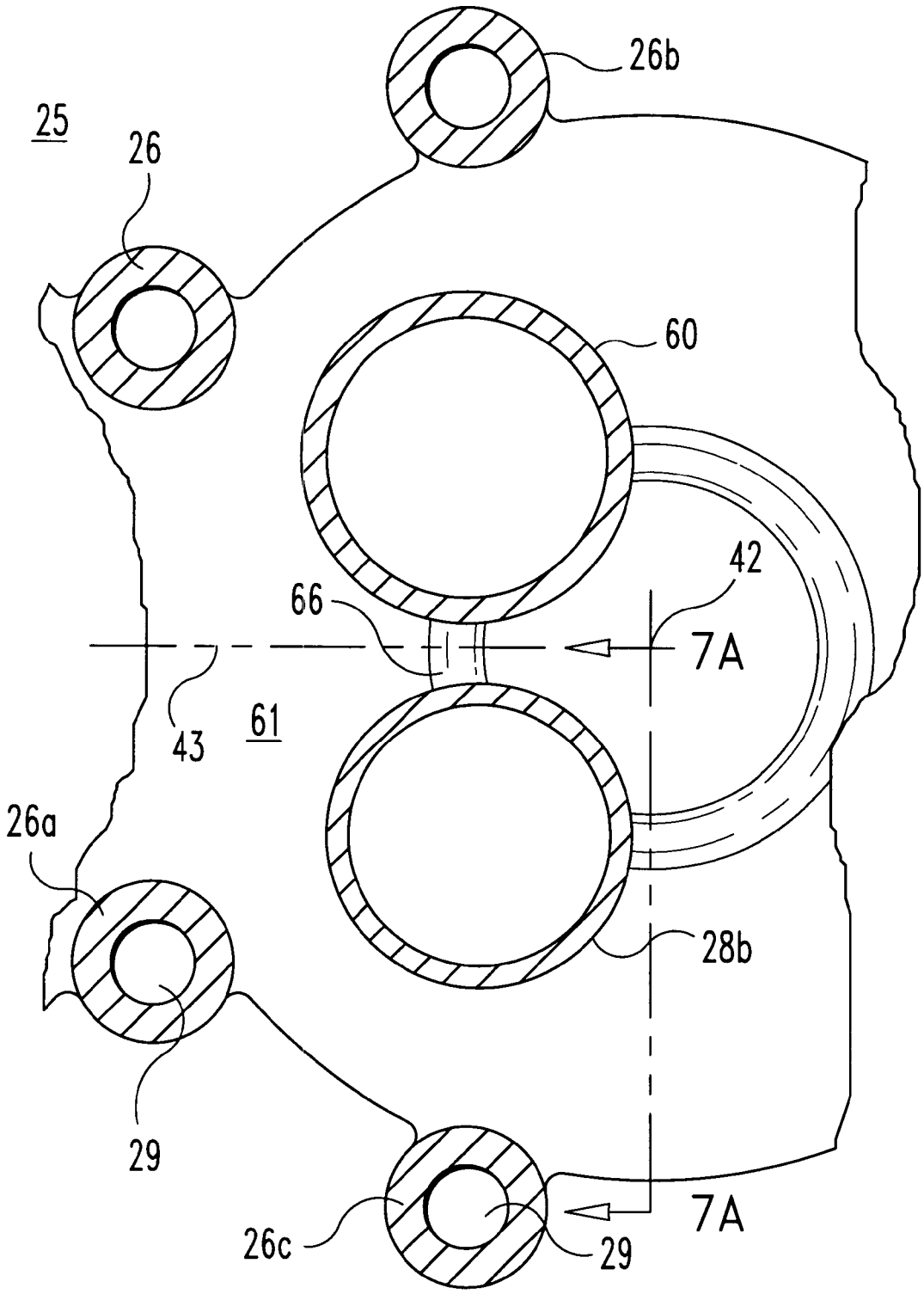
FIG. 8A is a partial, diagrammatic top plan view of a combustion deck according to another embodiment of the present invention.
Figure 8B:
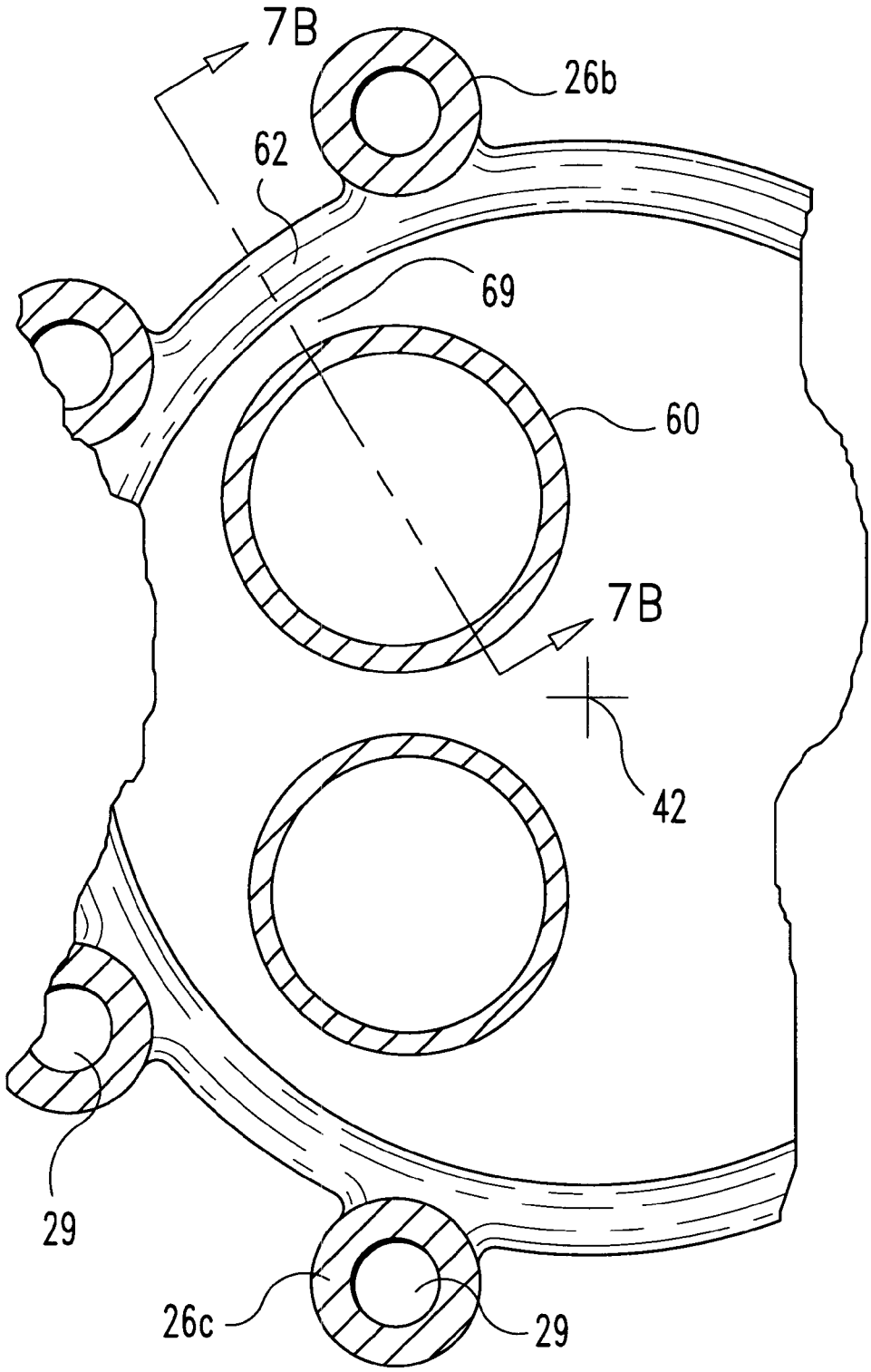
FIG. 8B is a partial, diagrammatic top plan view of a combustion deck according to another embodiment of the present invention.

The embodiments illustrated in FIGS. 7A and 7B are based on FIGS. 8A and 8B, respectively, and the corresponding cutting plane geometry. In FIG. 8A, cutting plane 7A—7A is illustrated and this cutting plane view yields the FIG. 7A view. Similarly, FIG. 8B includes cutting plane 7B—7B which yields the FIG. 7B view. Port 60 has been added as part of the FIG. 7A and FIG. 7B illustrations in order to show one further design consideration for the ribs 61 (FIG. 7A) and 62 (FIG. 7B) which represent alternative rib design embodiments in accordance with the present invention. Port 60 is intended to represent an exhaust port.

In the FIG. 7A embodiment, rib 61 has a cross sectional shape which is relatively shallow and very wide in comparison to rib 27. As such, the rib 61 extends into the valve bridge region and its inward edge 66 location is limited by increasing thermal stresses.

In the FIG. 7B embodiment, the rib 62 has a higher and more narrow cross sectional shape compared to rib 61. As such, rib 62 is closer to the shape of rib 27, except rib 62 has a top (upper) surface 68 which is substantially flat in the center and rounded on the outer edges (i.e., comers). The height of rib 62 is limited by the curvature of port wall 70 and by providing a clearance space 69 between rib 62 and the wall 70 of port 60. This clearance space is needed so that sand can be cleaned out at the conclusion of the sand-casting process which is used to create the combustion deck and rib. Due to the location of cutting plane 7B—7B which extends through port 60, the corresponding combustion deck location is open so as to permit flow, such as exhaust, up through the combustion deck 25 into port 60. While other components and forms would typically be present, such as a valve, these have been omitted for drawing simplicity and clarity.

With regard to the scope and applicability of the present invention, it can be applied to (a) single cylinder engines, (b) multi-cylinder engines with single cylinder heads, and (c) multi-cylinder engines with multi-cylinder heads.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A unitary combustion deck for an internal combustion engine, said internal combustion engine including at least one cylinder, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around said at least one cylinder while integrally interconnecting with each bolt boss of said plurality of bolt bosses, wherein said load distribution rib has a cross sectional shape which includes a peak positioned between two curved side portions.

2. The unitary combustion deck of claim 1 wherein said load distribution rib has a height dimension between said peak and said main body portion of between ⅛ inch and 1.0 inch.

3. A unitary combustion deck for an internal combustion engine, said internal combustion engine including at least one cylinder, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around said at least one cylinder while integrally interconnecting with each bolt boss of said plurality of bolt bosses, wherein said load distribution rib has a cross sectional shape which includes a substantially flat upper surface.

4. The unitary combustion deck of claim 3 wherein said load distribution rib has a height dimension between said peak and said main body portion of between ⅛ inch and 1.0 inch.

5. A unitary combustion deck for an internal combustion engine, said internal combustion engine including at least one cylinder, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around said at least one cylinder while integrally interconnecting with each bolt boss of said plurality of bolt bosses, wherein said load distribution rib is connected to each bolt boss of said plurality of bolt bosses by a concave fillet.

6. A unitary combustion deck for an internal combustion engine, said internal combustion engine including a plurality of cylinders, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around each cylinder of said plurality of cylinders while integrally interconnecting with each bolt boss of said plurality of bolt bosses, wherein said load distribution rib has a cross sectional shape which includes a peak positioned between two curved side portions.

7. The unitary combustion deck of claim 6 wherein said load distribution rib has a height dimension between said peak and said main body portion of between ⅛ inch and 1.0 inch.

8. A unitary combustion deck for an internal combustion engine, said internal combustion engine including a plurality of cylinders, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around each cylinder of said plurality of cylinders while integrally interconnecting with each bolt boss of said plurality of bolt bosses, wherein said load distribution rib has a cross sectional shape which includes a substantially flat upper surface.

9. The unitary combustion deck of claim 8 wherein said load distribution rib has a height dimension between said peak and said main body portion of between ⅛ inch and 1.0 inch.

10. A unitary combustion deck for an internal combustion engine, said internal combustion engine including a plurality of cylinders, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around each cylinder of said plurality of cylinders while integrally interconnecting with each bolt boss of said plurality of bolt bosses, wherein said load distribution rib is connected to each bolt boss of said plurality of bolt bosses by a concave fillet.

11. A unitary combustion deck for an internal combustion engine, said internal combustion engine including at least one cylinder, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around said at least one cylinder while integrally interconnecting with each bolt boss of said plurality of bolt bosses and while integrally interconnecting with said coolant-side surface, wherein said load distribution rib has a cross sectional shape which includes a peak positioned between two curved side portions.

12. A unitary combustion deck for an internal combustion engine, said internal combustion engine including at least one cylinder, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around said at least one cylinder while integrally interconnecting with each bolt boss of said plurality of bolt bosses and while integrally interconnecting with said coolant-side surface, wherein said load distribution rib has a cross sectional shape which includes a substantially flat upper surface.

13. A unitary combustion deck for an internal combustion engine, said internal combustion engine including at least one cylinder, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around said at least one cylinder while integrally interconnecting with each bolt boss of said plurality of bolt bosses and while integrally interconnecting with said coolant-side surface, wherein said load distribution rib is connected to each bolt boss of said plurality of bolt bosses by a concave fillet.

14. A unitary combustion deck for an internal combustion engine, said internal combustion engine including a plurality of cylinders, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around each cylinder of said plurality of cylinders while integrally interconnecting with each bolt boss of said plurality of bolt bosses and while integrally interconnecting with said coolant-side surface, wherein said load distribution rib has a cross sectional shape which includes a peak positioned between two curved side portions.

15. A unitary combustion deck for an internal combustion engine, said internal combustion engine including a plurality of cylinders, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around each cylinder of said plurality of cylinders while integrally interconnecting with each bolt boss of said plurality of bolt bosses and while integrally interconnecting with said coolant-side surface, wherein said load distribution rib has a cross sectional shape which includes a substantially flat upper surface.

16. A unitary combustion deck for an internal combustion engine, said internal combustion engine including a plurality of cylinders, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around each cylinder of said plurality of cylinders while integrally interconnecting with each bolt boss of said plurality of bolt bosses and while integrally interconnecting with said coolant-side surface, wherein said load distribution rib is connected to each bolt boss of said plurality of bolt bosses by a concave fillet.

17. A unitary combustion deck for an internal combustion engine, said internal combustion engine including at least one cylinder, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-like form around said at least one cylinder while integrally interconnecting with each bolt boss of said plurality of bolt bosses, said load distribution rib having a lower surface, the entirety of said lower surface being unitary with said coolant-side surface between adjacent bolt bosses of said plurality of bolt bosses.

18. A unitary combustion deck for an internal combustion engine, said internal combustion engine including a plurality of cylinders, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around each cylinder of said plurality of cylinders while integrally interconnecting with each bolt boss of said plurality of bolt bosses, said load distribution rib having a lower surface, the entirety of said lower surface being unitary with said coolant-side surface between adjacent bolt bosses of said plurality of bolt bosses.

19. A unitary combustion deck for an internal combustion engine, said internal combustion engine including at least one cylinder, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around said at least one cylinder while integrally interconnecting with each bolt boss of said plurality of bolt bosses and while integrally interconnecting with said coolant-side surface, said load distribution rib having a lower surface, the entirety of said lower surface being unitary with said coolant-side surface between adjacent bolt bosses of said plurality of bolt bosses.

20. A unitary combustion deck for an internal combustion engine, said internal combustion engine including a plurality of cylinders, said combustion deck comprising:

a main body portion having a cylinder-facing surface and a coolant-side surface;

a plurality of bolt bosses integral with said coolant-side surface, each bolt boss of said plurality of bolt bosses defining a bolt-receiving aperture which extends through said main body portion; and a load distribution rib constructed and arranged to extend in a ring-shaped form around each cylinder of said plurality of cylinders while integrally interconnecting with each bolt boss of said plurality of bolt bosses and while integrally interconnecting with said coolant-side surface, said load distribution rib having a lower surface, the entirety of said lower surface being unitary with said coolant-side surface between adjacent bolt bosses of said plurality of bolt bosses.

* * * * *

UNITED STATES PATENT AND TRADEMARK OFFICE

CERTIFICATE OF CORRECTION

PATENT NO. : 6,343,574 B1 
DATED : February 5, 2002
INVENTOR(S) : Jay F. Leonard et al.

It is certified that error appears in the above-identified patent and that said Letters Patent is hereby corrected as shown below:

Column 5,
Line 18, between "41." and "This load", insert the following two sentences:
-- As illustrated, the lower surface of the load distribution rib 27 is unitary with the upper surface of the combustion deck 25. This unitary contact is continuous throughout the entirety of rib 27. --

Column 6,
Line 44, replace "comers" with -- corners --.

Signed and Sealed this

Twentieth Day of August, 2002

*Attest:*

*Attesting Officer*

JAMES E. ROGAN
*Director of the United States Patent and Trademark Office*